US007789374B2

(12) United States Patent
Averill et al.

(10) Patent No.: US 7,789,374 B2
(45) Date of Patent: Sep. 7, 2010

(54) CONTROL ARRANGEMENT FOR INTEGRATED COMPRESSOR AND WINCH

(75) Inventors: Bryan M. Averill, Portland, OR (US); Richard J. Geisler, Oregon City, OR (US); Steven W. Shuyler, Clackamas, OR (US); Oliver Heravi, Tigard, OR (US)

(73) Assignee: Warn Industries, Inc., Milwaukie, OR (US)

( * ) Notice: Subject to any disclaimer, the term of this patent is extended or adjusted under 35 U.S.C. 154(b) by 501 days.

(21) Appl. No.: 11/760,378

(22) Filed: Jun. 8, 2007

(65) Prior Publication Data

US 2008/0061276 A1 Mar. 13, 2008

Related U.S. Application Data

(60) Provisional application No. 60/825,327, filed on Sep. 12, 2006.

(51) Int. Cl.
*B66D 1/00* (2006.01)

(52) U.S. Cl. ..... 254/323; 254/361

(58) Field of Classification Search ..... 254/323, 254/361, 328

See application file for complete search history.

(56) References Cited

U.S. PATENT DOCUMENTS 5,794,920 A * 8/1998 Kronberger ..... 254/361
5,997,426 A * 12/1999 Ito et al. ..... 475/80
6,012,707 A * 1/2000 Enlund ..... 254/361
6,431,103 B1 * 8/2002 Meyerdierks ..... 114/218
6,604,731 B2 * 8/2003 Hodge ..... 254/344
6,658,852 B2 * 12/2003 Frey ..... 60/716
7,063,306 B2 * 6/2006 Sanders et al. ..... 254/361
7,163,207 B2 * 1/2007 Baird et al. ..... 280/6.153
7,311,298 B2 * 12/2007 Giacomini ..... 254/323
7,543,798 B2 * 6/2009 Cunningham ..... 254/266
7,559,534 B2 * 7/2009 Giacomini et al. ..... 254/323
2006/0278860 A1 * 12/2006 Giacomini ..... 254/323
2007/0221898 A1 * 9/2007 Giacomini et al. ..... 254/323

* cited by examiner

*Primary Examiner*—Evan H Langdon
(74) *Attorney, Agent, or Firm*—Harness, Dickey & Pierce, P.L.C.

(57) ABSTRACT

A control arrangement is provided for an integrated compressor and winch assembly. The integrated assembly includes: a clutch mechanically coupled to an electric motor and selectively engageable with at least one of a compressor or a winch mechanism; an electrical control circuit having an operational mode for controlling the compressor and another operational mode for controlling the winch mechanism; and a mode selector in communication with the clutch and the electrical control circuit, whereby actuating the mode selector actuates the clutch and selects an operational mode for the control circuit.

12 Claims, 6 Drawing Sheets

FIG 4B
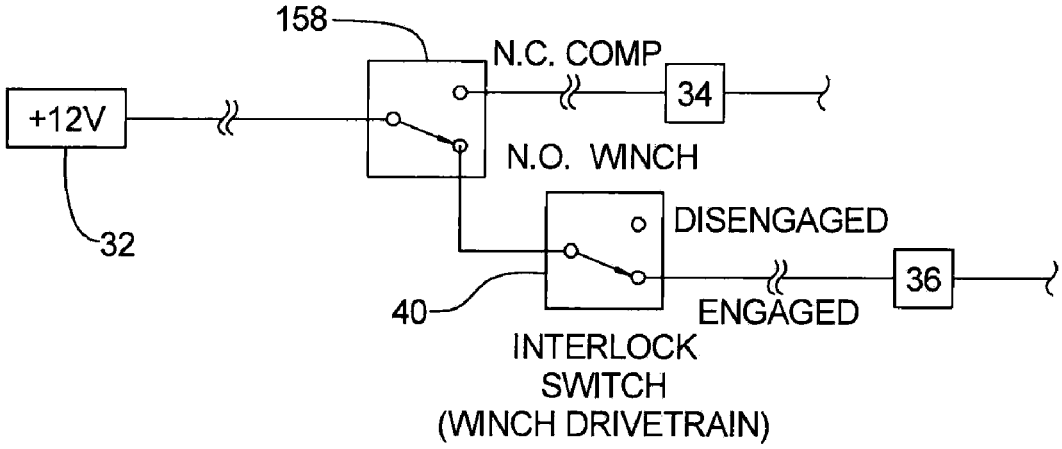
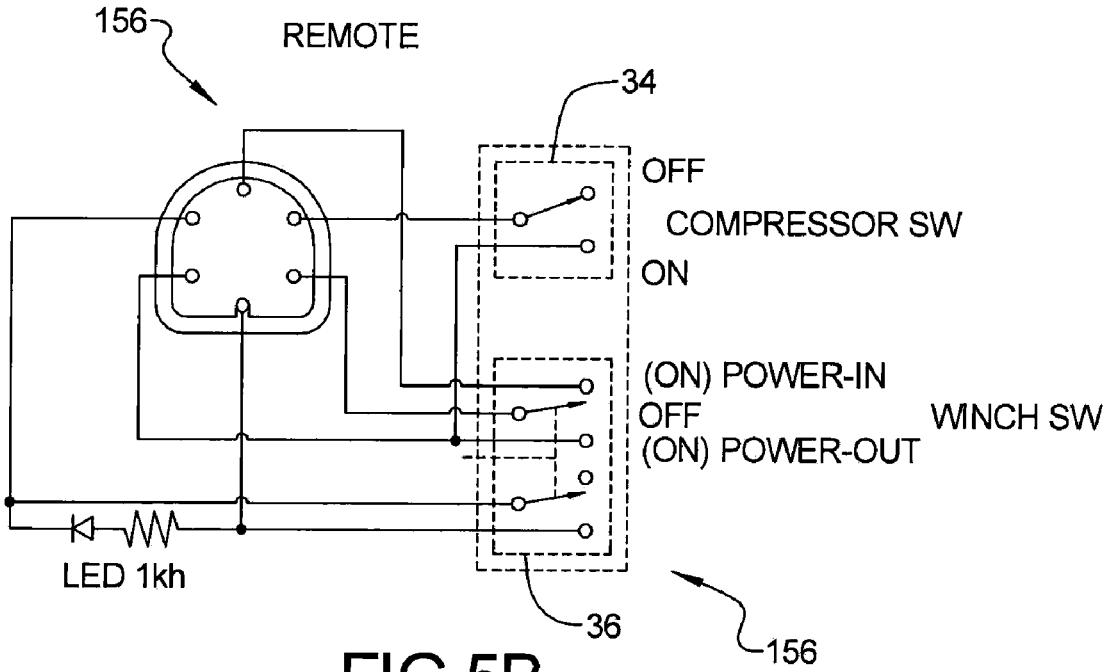
FIG 5B

CONTROL ARRANGEMENT FOR INTEGRATED COMPRESSOR AND WINCH

CROSS-REFERENCE TO RELATED APPLICATIONS

This application claims the benefit of U.S. Provisional Application No. 60/825,327, filed on Sep. 12, 2006. The disclosure of the above application is incorporated herein by reference.

FIELD

The present disclosure relates to an integrated air compressor and winch mechanism and, more particularly, to a control arrangement for operating an integrated air compressor and winch mechanism.

BACKGROUND AND SUMMARY

Winches have been commonly mounted on vehicles and used to perform a variety of tasks, such as dragging a large object while the vehicle is stationary or towing the vehicle itself by attaching the free end of the winch cable to a stationary object and reeling in the cable to pull the vehicle toward the object. Winches are particularly useful for off-road and utility vehicles. However, it is still desirable to enhance the functionality of winches in these types of applications.

More recently, it has been proposed to integrate the winch mechanism with an air compressor to provide additional utility as disclosed in commonly assigned U.S. patent application Ser. No. 11/149,492 which is herein incorporated by reference in its entirety. Briefly, the integrated air compressor and winch mechanism use a common drive motor for driving both the compressor and the winch mechanism. What is needed is a suitable control arrangement for operating the integrated air compressor and winch mechanism.

Therefore, a control arrangement is provided for an integrated compressor and winch assembly; the integrated assembly comprising: a clutch mechanically coupled to an electric motor and selectively engageable with at least one of a compressor or a winch mechanism; an electrical control circuit having an operational mode for controlling the compressor and another operational mode for controlling the winch mechanism; and a mode selector in communication with the clutch and the electrical control circuit, whereby actuating the mode selector actuates the clutch and selects an operational mode for the control circuit.

In another aspect of this disclosure, the control circuit employs two parallel circuit paths, such that the mode selector switch is engaged with either one of the two paths for selecting the operational mode of the integrated assembly. One of the circuit paths provides a switch for controlling the operation of the compressor while the other circuit path provides a switch for controlling the operation of the winch mechanism.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 4A:
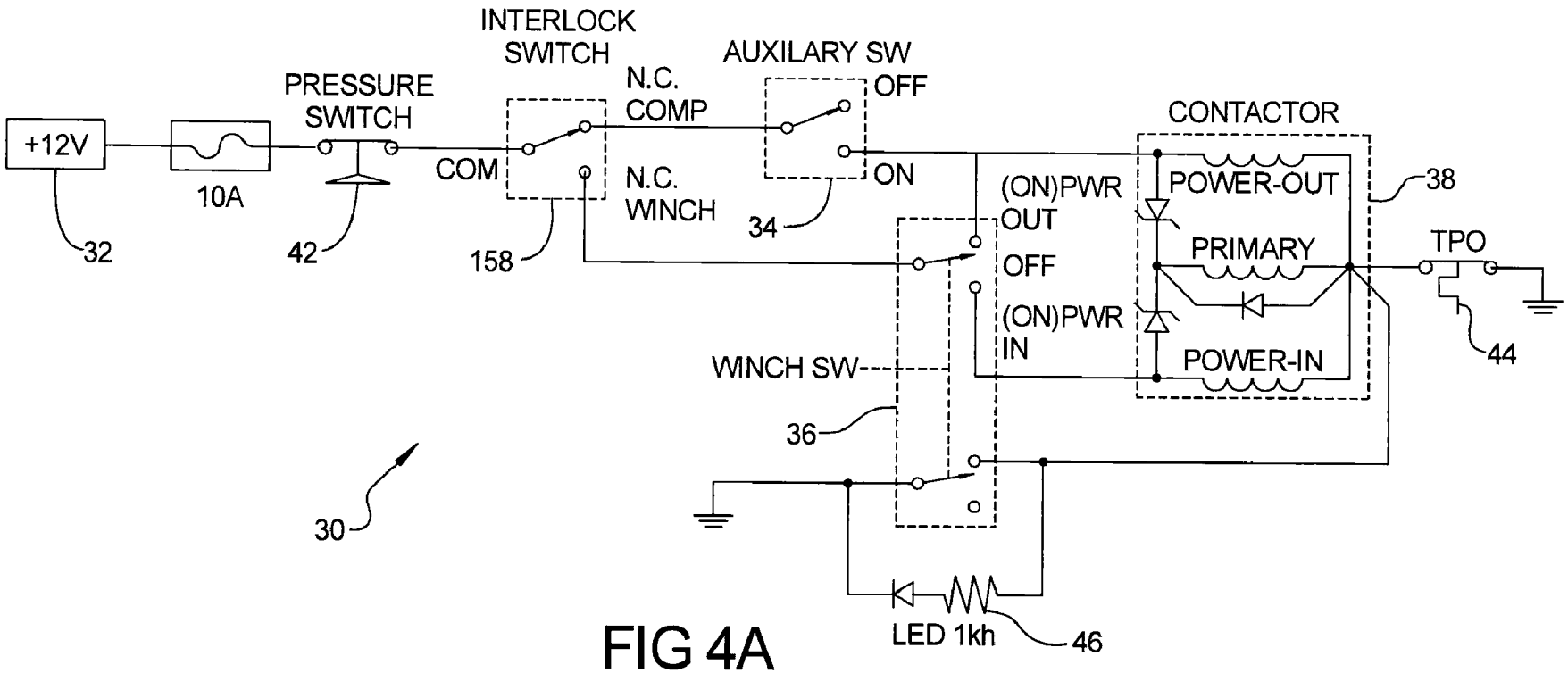
Figure 5A:
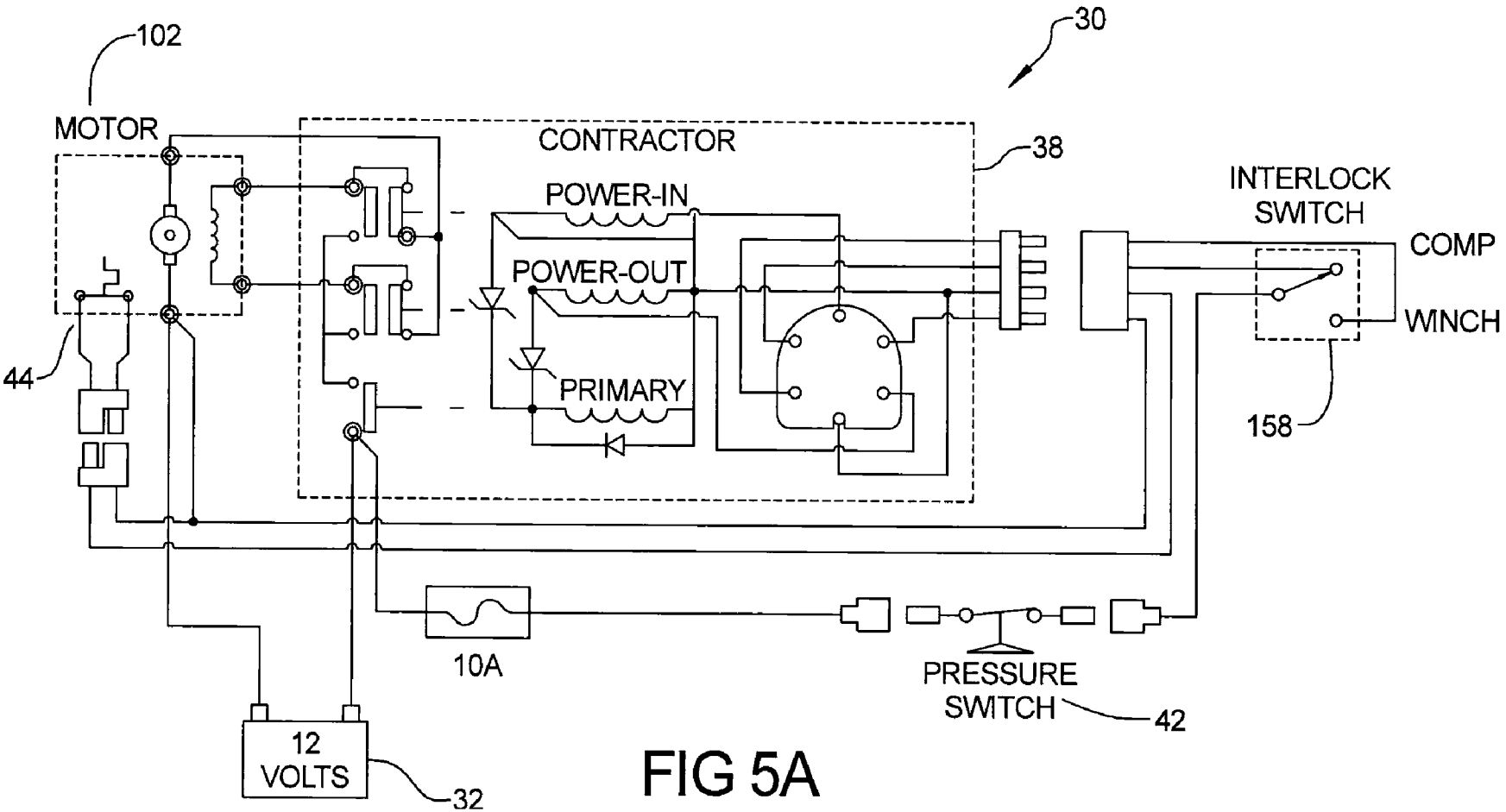

FIGS. 4*a*-4*b* are electrical diagrams depicting an exemplary control arrangement and alternate embodiment for the integrated air compressor and winch; and FIG. 5 is an electrical diagram depicting the exemplary control arrangement in more detail.

DETAILED DESCRIPTION

Figure 1:
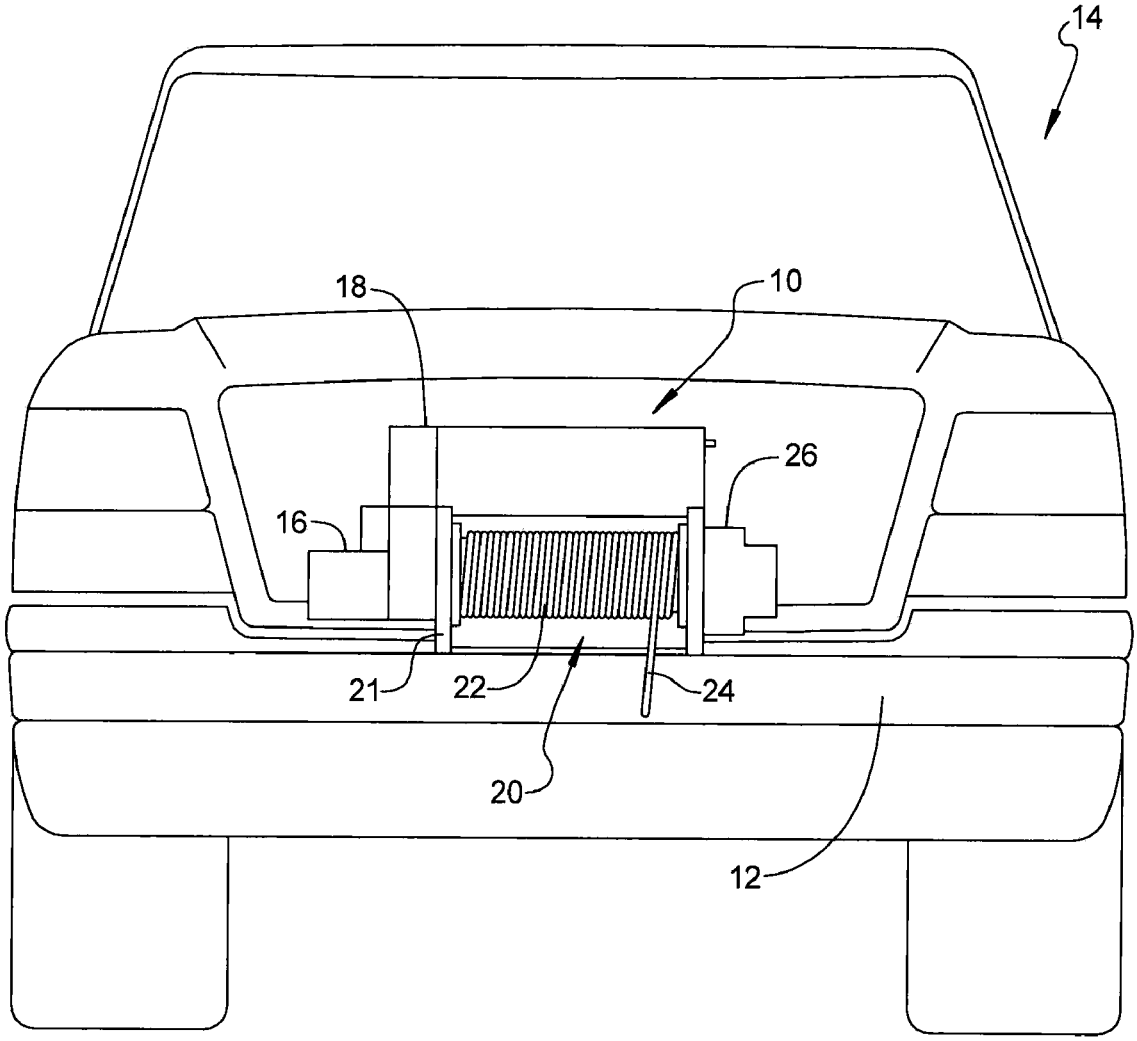
FIG. 1 illustrates an exemplary integrated air compressor and winch assembly.

FIG. 1 illustrates an exemplary integrated air compressor and winch assembly 10 mounted to a front bumper 12 of a vehicle 14. The assembly 10 is generally comprised of an electric motor 16, an air compressor 18 and a winch mechanism 20 mounted on a common support structure 21. The winch mechanism 20 is further defined as a rotatable drum mechanism 22 and a cable 24 which is to be wound on and off the drum mechanism 22. In this example, the electric motor 16 and air compressor 18 are arranged on one side of the drum mechanism 22 and a gear case 26 is arranged on the opposite side of the drum mechanism 22. It is to be understood that other variations of this arrangement could also be utilized in which the motor, gear case, and compressor can all be mounted on the same side; the motor and gear case can be mounted on one side with the compressor on the other side; or with the motor mounted on one side and compressor and the gear case on the other side. Furthermore, other configurations with the motor and/or compressor being non-coaxially mounted with the drum can also be utilized. While the integrated air compressor and winch assembly is shown in the context of a vehicle, it is readily understood that it is suitable for other applications.

Figure 2:
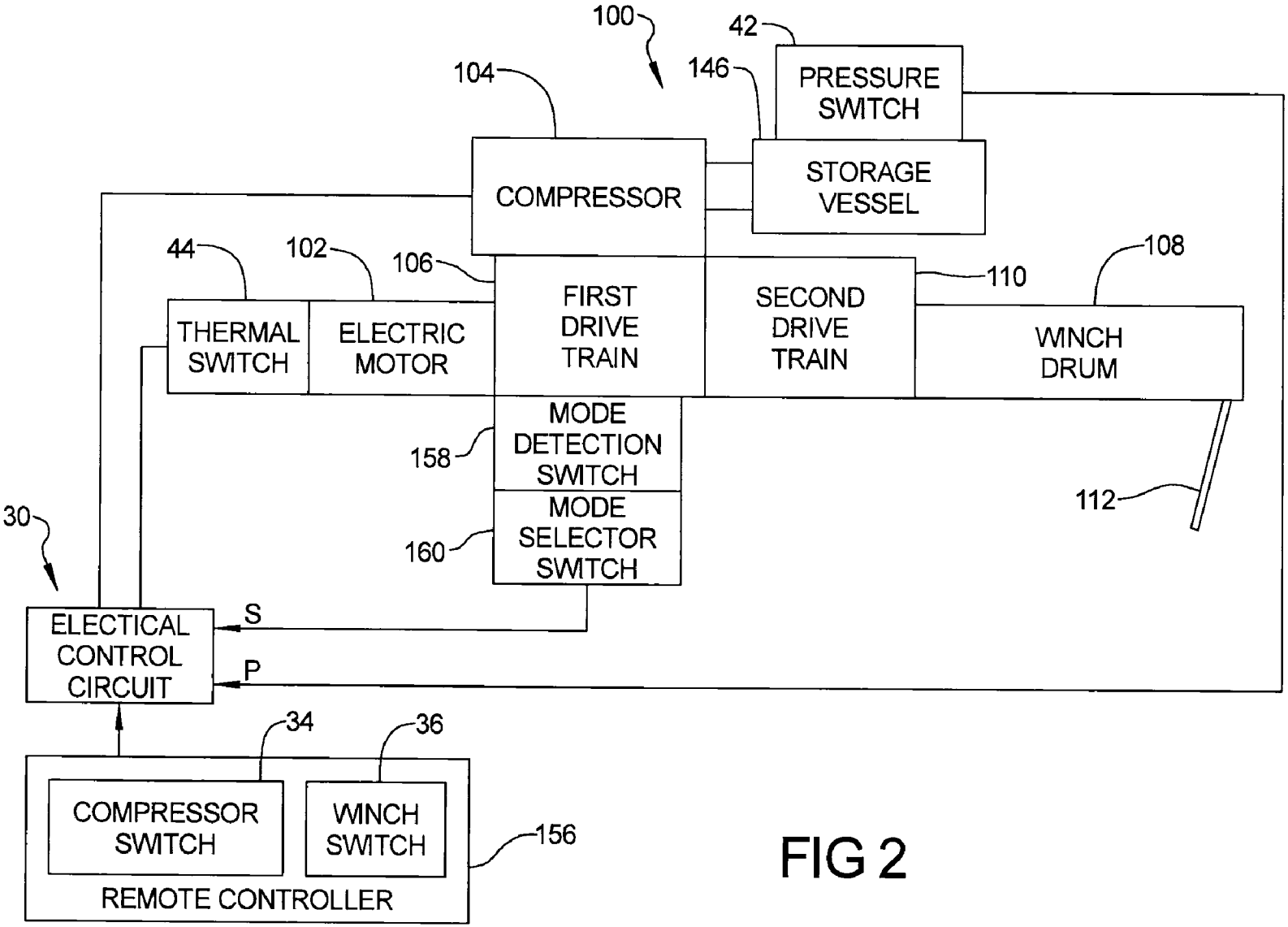
FIG. 2 is a system block diagram of a control arrangement for an integrated air compressor and winch according to the principles of the present disclosure.
Figure 3:
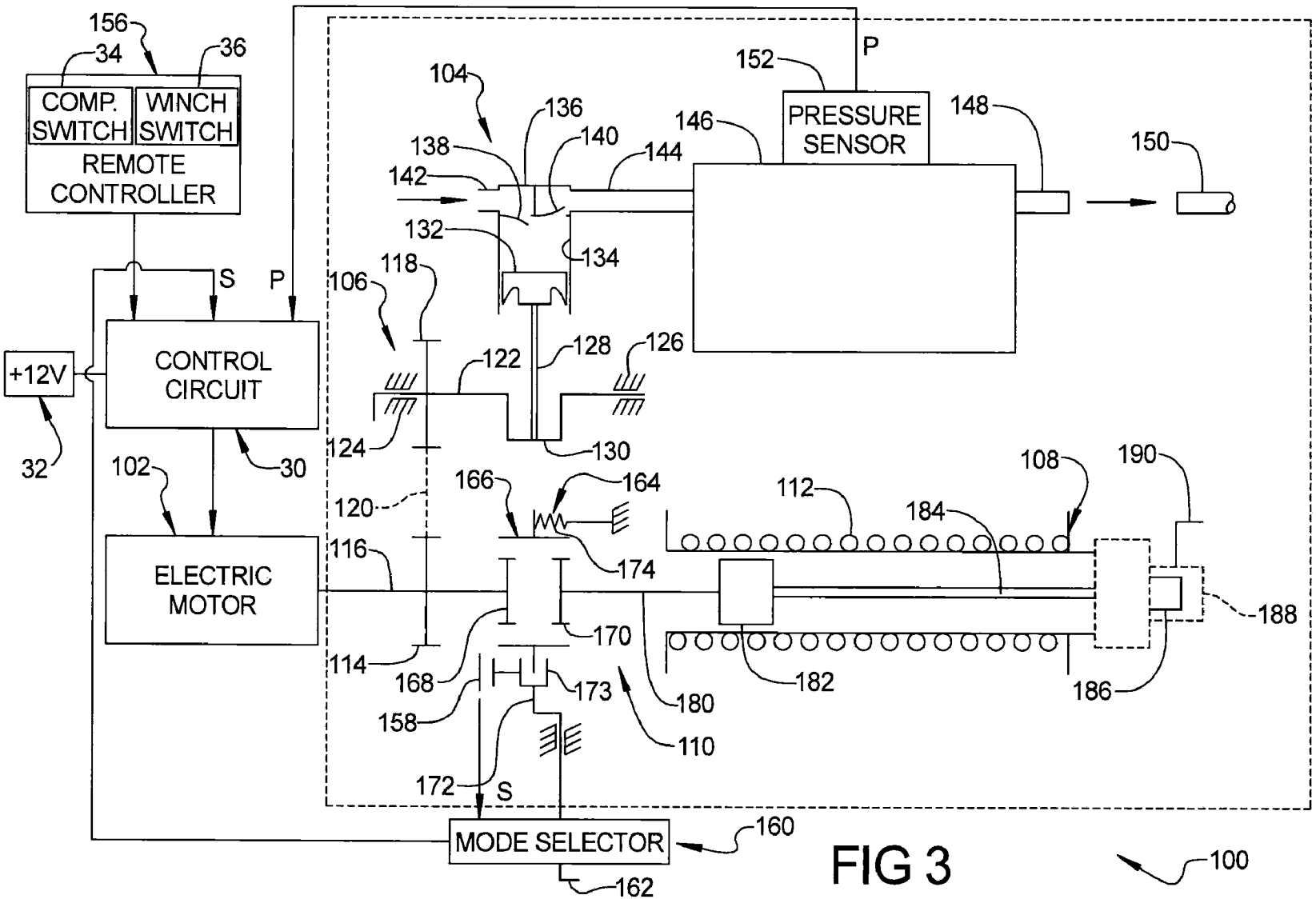
FIG. 3 is a schematic diagram depicting an exemplary embodiment of the control arrangement for the integrated air compressor and winch according to the principles of the present disclosure.

FIGS. 2-3 illustrate an exemplary embodiment of how the electric motor may be configured to drive both the compressor and the winch mechanism. In FIG. 3, the integrated air compressor and winch 100 has been illustrated schematically. In this exemplary embodiment, an electric motor 102 is connected to a compression mechanism 104 by a first drive train 106. The integrated air compressor and winch 100 also includes a drum 108 connected to the electric motor 102 by a second drive train 110. The drum 108 receives a cable 112 that is capable of being wound on to and wound off from the drum 108 when the drum 108 is rotated.

The first drive train 106 includes a drive pulley 114 connected to the output shaft 116 of electric motor 102. An offset driven pulley 118 is connected to the drive pulley 114 by a drive belt 120. The drive pulley 114 and driven pulley 118 can provide a drive ratio reduction relative to the electric motor output shaft 116. The driven pulley 118 is connected to a crank shaft 122 rotatably supported at opposite ends by bearing assemblies 124, 126. A connecting rod 128 is connected to an eccentric portion 130 of crank shaft 122 and is connected to a piston 132 which is disposed within a cylinder 134. A cylinder head 136 is mounted to the cylinder 134 and supports an intake read valve 138 and an outlet read valve 140 therein. An air intake fitting 142 is provided in communication with the intake read valve 138. An outlet passage 144 is provided in communication with the outlet read valve 140 and communicates with an intercooler storage vessel 146. The intercooler storage vessel 146 can be provided with cooling fins to facilitate cooling of the compressed air received therein. An outlet fitting 148 is connected to the intercooler storage vessel 146 and is adapted to be releasably connected to a hose 150. A pressure sensor 152 may be provided for providing a pressure signal P to the control circuit 30 which controls operation of the assembly.

Actuation of a mode selector 160 amongst two user-selectable positions selects the operational mode for the assembly. In the exemplary embodiment, two positions are defined as a compressor mode and a winch mode. In compressor mode, the compressor is operational but the winch is not. In the winch mode, the winch is operational.

More specifically, the mode selector 160 includes a lever 162 operable by a user for engaging a clutch mechanism 164 for connecting the second drive train 110 to the first drive train 106. The clutch mechanism 164 includes an internally splined clutch ring 166 that is slidable between engaged and disengaged positions for providing drive torque from an externally splined drive member 168 connected to the electric motor output shaft 116. The drive member 168 can be selectively coupled to an externally splined driven member 170 by the clutch ring 166 being in driving engagement with the drive member 168 and driven member 170. The mode selector 160 is provided with an eccentric portion 172 which engages a shift fork 173 connected to the clutch ring 166 to cause axial movement of the clutch ring 166 between the engaged and disengaged positions. A biasing spring 174 is provided for biasing the clutch ring 166 from a disengaged position towards an engaged position. Alternatively, it should be understood that the biasing spring 174 could be configured to bias the clutch ring 166 from the engaged position to a disengaged position.

The second drive train 110 includes a shaft 180 connected to the driven member 170 and connected to a brake mechanism 182 disposed within the drum 108. The brake mechanism 182 is connected to an output shaft 184 that extends through the center of the drum 108 and engages a planetary gear assembly 186 contained within gear housing 188. The planetary gear assembly 186 is selectively engageable with the drum 108. A shift lever 190 is provided for shifting the planetary gear assembly between a drive and neutral positions. It should be understood that the brake mechanism 182 and planetary gear assembly 186 are generally known in the art as shown in commonly assigned U.S. Pat. Nos. 5,482,255; 5,261,646 and 4,461,460 each of which is herein incorporated by reference in their entirety.

The mode selector 160 also interfaces with a mode detection switch 158. As the lever 162 is moved between the compressor mode position and the winch mode position, the mode detection switch 158 is actuated between a compressor position and a winch position. The positions of the mode detection switch 158 configure the control circuit 30 for the corresponding operational mode in the manner further described below.

An exemplary control arrangement for an integrated air compressor and winch assembly is shown in FIG. 4*a*. In the exemplary arrangement, the electrical control circuit 30 includes an electrical power source 32 (e.g., a 12 volt battery), the mode detection switch 158, a first switch 34 for controlling operation of the air compressor, a second switch 36 for controlling operation of the winch, and a contactor 38 for interfacing with the electric motor. In particular, the first switch 34 may be disposed in a first circuit path; whereas the second switch 36 may be disposed in a second circuit path which is in parallel with the first circuit path. The mode detection switch 158 is electrically coupled to the electrical power source 32 and disposed between the power source 32 and the two circuit paths. The two circuit paths are each electrically coupled to the contactor 38 which in turn is electrically coupled to the electric motor 102. Actuation of the mode detection switch 158 selectively engages either the first circuit path or the second circuit path, thereby enabling the switch in the selected circuit path.

The control arrangement preferably employs two different types of switches for controlling the compressor and the winch. For instance, the switch 34 for controlling the compressor 104 may be a simple toggle switch having on/off positions. When in compressor mode, the compressor 104 will run continuously when this switch 34 is placed in the on position and will stop running when it is placed in the off position. When in winch mode, switch 34 is not functional.

Conversely, the switch 36 for controlling the winch is preferably a momentary type switch having three positions. In a center position, the winch is in an off state. The switch 36 for controlling the winch must then be actuated to one of the other two positions. In one position, the drum 108 is rotated in a direction that winds the cable (i.e., power-in). In the other position, the drum 108 is rotated in a direction that unwinds the cable (i.e., power-out). When the switch 36 is released by the operator, it returns to the center position, thereby terminating rotation of the drum. In other words, when in winch mode, the drum of the winch is rotated only while the switch is being actuated by the operator into one of the two operating positions. To operate the winch, the mode detector switch 158 is first placed in winch mode. When mode detector switch 158 is in compressor mode, the switch 36 for controlling the winch is not functional.

Switches for controlling the compressor and the winch may be embedded into a control panel on the integrated assembly. Alternatively, these two switches 34, 36 may reside in a remote controller 156 as shown in FIGS. 2, 3 and 5. In the exemplary embodiment, the remote controller 156 is electrically coupled by a cable to the integrated assembly. The cable is detachably coupled by a plug to the integrated assembly. The remote controller 156 may also be coupled by a wireless communication link to the integrated assembly. Different configurations and types of switches are contemplated by this disclosure. Moreover, it is envisioned that the two switches may be of the same type or that a single switch (in addition to the mode selector) may be used within the broader aspects of this disclosure.

On the mechanical side, the mode selector 160 may be mechanically coupled to the clutch 164 in the manner described above. In this way, actuation of the mode selector 160 directly actuates the clutch 164. In the winch position, the mode selector 160 actuates the clutch 164 so that the electric motor 102 is engaged with the drum 108 and rotary motion may be imparted to the drum 108. In the compressor position, the mode selector 160 actuates the clutch 164 so that the electric motor 102 is disengaged from the drum 108 and thus no rotary motion can be imparted to the drum. In the exemplary embodiment, the electric motor 102 remains engaged with the compressor 104 when the mode selector 160 is actuated to either position. As a result, the electric motor 102 will provide drive torque to the compressor 104 when the winch is being operated. However, it is envisioned that the clutch mechanism may be configured to engage the electric motor 102 to the compressor in the compressor position while disengaging the electric motor from the compressor in the winch position. It is also envisioned that the mode selector 160 may be configured to indirectly actuate the clutch. For instance, the mode selector 160 may interface with a microcontroller or other control circuit which in turn controls actuation of the clutch 164 based on the position of the mode selector.

The control circuit 30 may include three additional features. First, a pressure switch 42 prevents excessive build up of pressure in the compressor 104. Thus, the pressure switch 42 is preferably located in or in communication with a sensor in the intercooler storage vessel 146. In the control circuit, the pressure switch 42 is disposed generally between the electrical power source 32 and the electric motor 102. In the exemplary embodiment, the pressure switch 42 has a normally closed state and is positioned between the electrical power source 32 and the mode detector switch 158. Since the compressor 104 remains engaged with the electric motor 102 in winch mode, the pressure switch 42 should be placed upstream from the mode detector switch 158. In an arrangement where the compressor 104 disengages from the electric motor 102 in winch mode, the pressure switch 42 could be positioned in the circuit path having the compressor control switch 34.

When pressure exceeds some threshold, the pressure switch 42 enters an open state, thereby preventing further operation of the compressor 104. The pressure switch 42 is designed to return to a closed state once the pressure decreases below the threshold, thereby restoring operation of the assembly. A variety of commercially available pressure switches are suitable for this application.

Second, a thermal protection device 44 prevents the electric motor 102 from overheating. A thermal protection device 44 having a normally closed state is disposed inside the casing for the electric motor 102. When the temperature of the motor 102 exceeds some temperature threshold, the thermal protection device 44 forms an open circuit which interrupts motor operation. In addition, a light emitting diode (LED) 46 is illuminated to alert the operator that the motor has overheated. The thermal protection device 44 is operable to return to a closed state once the temperature falls below the temperature threshold.

In the exemplary embodiment, the thermal protection device 44 is operable when in compressor mode and when the winch is operating in power in mode. In other words, the thermal protection device 44 is not activated when the winch is operated in the power out mode. This may be achieved by placing the thermal protection device 44 on the ground side of the control circuit and providing an alternative ground path when the winch is operated in power out mode. If the motor overheats during a winch operation, this design allows the winch to be returned to its starting position, if desirable. Likewise, a variety of devices are commercially available for implementing this feature.

The foregoing description of the invention is merely exemplary in nature and, thus, variations that do not depart from the gist of the invention are intended to be within the scope of the invention. Such variations are not to be regarded as a departure from the spirit and scope of the invention.

What is claimed is:

1. A control system for an integrated compressor and winch mechanism, comprising:

a mechanical clutch mechanically coupled to a source of rotary motive power and selectively engageable with at least one of a compressor or a winch mechanism, wherein the source of rotary motive power is configured to drive both the compressor and the winch mechanism;

an electrical control circuit having two operating modes, a first operational mode for controlling the compressor and a second operational mode for controlling the winch mechanism; and a mode selector in communication with the mechanical clutch and the electrical control circuit, whereby actuating the mode selector actuates the clutch and selects an operational mode for the control circuit.

2. The control system of claim 1 wherein the mode selector is mechanically coupled to the clutch to directly actuate the clutch.

3. The control system of claim 1 wherein the mechanical clutch selectively engages the source of rotary motive power to the winch mechanism.

4. The control system of claim 1 wherein the source of rotary motive power is an electric motor and the winch mechanism is a drum mechanism and a cable adapted to be wound onto and off the drum mechanism.

5. The control system of claim 4 wherein the electrical control circuit includes a thermal protection device disposed proximate to the electric motor and having an open state when a temperature near the electric motor exceeds a threshold.

6. The control system of claim 1 wherein the mode selector includes a mode detection switch.

7. The control system of claim 1 wherein the electrical control circuit includes a first circuit path for controlling operation of a compressor and a second circuit path for controlling operation of a winch mechanism, where the first circuit path is in parallel with the second circuit path and the mode selector selectively engages either the first circuit path or the second circuit path.

8. The control system of claim 1 wherein the second circuit path having a momentary switch for operating the winch mechanism and the first circuit path having a switch of a different type than the momentary switch.

9. The control system of claim 1 wherein the electrical control circuit includes a pressure switch having an open state when pressure associated with the compressor exceeds a threshold.

10. The control system of claim 1 wherein the source of rotary motive power, the compressor, and the winch mechanism are supported by a common mounting support.

11. The control system of claim 1 further comprising a switch operable by a user, whereby actuating the switch actuates the clutch.

12. A control system for an integrated compressor and winch mechanism, comprising:

a mechanical clutch mechanically coupled to a source of rotary motive power and selectively engageable with at least one of a compressor or a winch mechanism, wherein the source of rotary motive power is configured to drive both the compressor and the winch mechanism;

an electrical control circuit having two operating modes, a first operational mode for controlling the compressor and a second operational mode for controlling the winch mechanism; and a mode selector remotely located from the electrical control circuit, said mode selector in communication with the mechanical clutch and the electrical control circuit, wherein the mode selector is mechanically coupled to the clutch to directly actuate the clutch, and whereby actuating the mode selector actuates the clutch and selects an operational mode for the control circuit.

* * * * *